US006119427A

United States Patent [19]

Wyman et al.

[11] Patent Number: 6,119,427

[45] Date of Patent: Sep. 19, 2000

[54] APPARATUS AND METHOD OF MODULAR PANEL CONSTRUCTION

[75] Inventors: Larry W. Wyman, Louisville; James V. Kinser, Jr., La Grange, both of Ky.

[73] Assignee: Louisville Cooler Manufacturing Co., Louisville, Ky.

[21] Appl. No.: 09/069,385

[22] Filed: Apr. 29, 1998

[51] Int. Cl.[7] ..... E04B 2/08

[52] U.S. Cl. ..... 52/584.1; 52/582.2; 52/587.1; 52/309.9; 52/127.7; 52/127.9; 52/127.11; 52/709; 52/710

[58] Field of Search ..... 52/582.2, 584.1, 52/587.1, 309.9, 710, 127.7, 127.9, 127.11, 709

[56] References Cited

U.S. PATENT DOCUMENTS

| | | |
|---|---|---|
| 1,727,296 | 9/1929 | Matte, Jr. . |
| 1,878,921 | 9/1932 | White . |
| 1,934,760 | 11/1933 | Awbrey . |
| 2,006,300 | 6/1935 | Kinninger . |
| 2,647,287 | 8/1953 | Jones . |
| 2,924,089 | 2/1960 | Reiland . |
| 4,370,838 | 2/1983 | Vermillion . |
| 5,022,200 | 6/1991 | Wilson et al. . |
| 5,038,535 | 8/1991 | Van Pragg, III . |

*Primary Examiner*—Carl D. Friedman
*Assistant Examiner*—Patrick J. Chavez
*Attorney, Agent, or Firm*—King and Schickli, PLLC

[57] ABSTRACT

A structure wall includes first and second cooperating building panels. The first building panel includes first and second skins forming respective first and second opposed panel faces and a first foam filled core between the first and second skins. A portion of the foam filled core defines a groove that extends substantially continuously across the first building panel. A slotted rail extends substantially continuously across this groove. The second building panel includes third and fourth skins forming third and fourth opposed panel faces. A second foam filled core is provided between the third and fourth skins. The second foam filled core has at least one latch which may be extended from the panel to selectively engage the slotted rail at substantially any position along the rail. In this way, it is possible to provide substantially infinite adjustability of the position of the second building panel relative to the first building panel while also providing a secure and reliable connection therebetween.

19 Claims, 5 Drawing Sheets

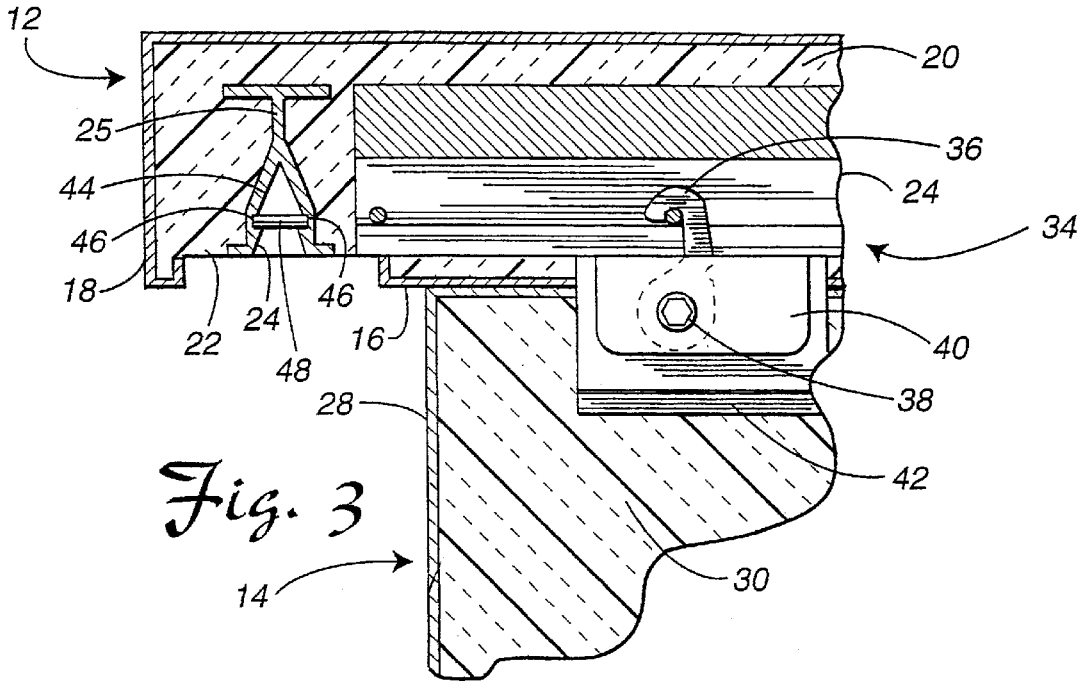
Fig. 3
Fig. 4
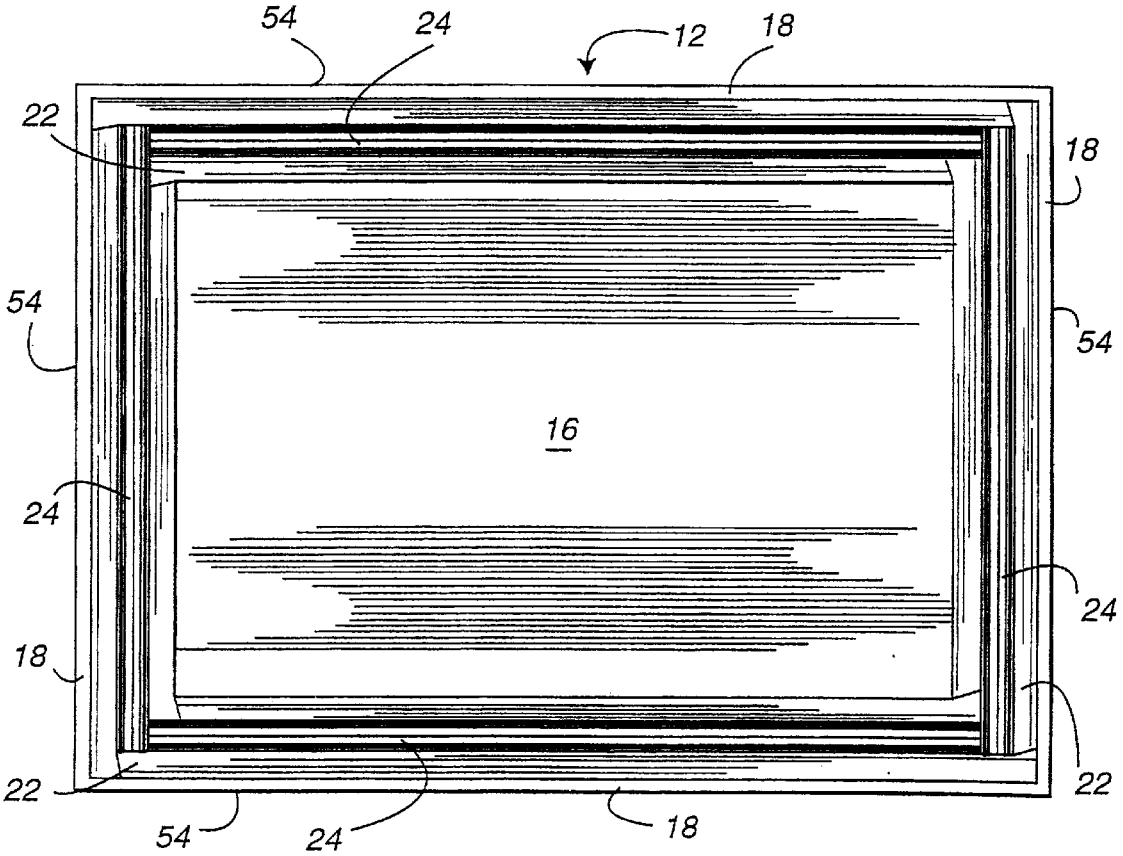

APPARATUS AND METHOD OF MODULAR PANEL CONSTRUCTION

TECHNICAL FIELD

The present invention relates generally to the field of wall construction and, more specifically, to a method and apparatus providing flexibility of design and user convenience heretofore unavailable in the art.

BACKGROUND OF THE INVENTION

It has long been known in the art to construct enclosures such as coolers, freezers and refrigerated warehouses from a series of modular wall panels. These panels are generally interconnected by a cooperating hook and pin arrangement.

Specifically, as shown in FIG. 1A wall panel W includes a foam filled core C sandwiched between inner and outer metal skins $S_1$, $S_2$, respectively. Similarly, ceiling wall panel P includes a foam filled core C' sandwiched between inner and outer skins $S_1'$, $S_2'$, respectively. Wall panel W also includes an eccentric latching hook H. The tongue T on the wall panel W is inserted into the groove G of the ceiling panel P. Then the hook H is pivoted into engagement with the latching pin L carried in the ceiling panel P in order to secure these two panels together. Examples of such prior art panel constructions are disclosed in, for example, U.S. Pat. No. 3,784,240 to Berkowitz and U.S. Pat. No. 4,574,537 to Krieger.

While such construction panel systems have enjoyed enormous popularity, they are not without their shortcomings. As shown in FIG. 1B, the ceiling panel P in state-of-the-art panel systems only includes latching pins L in short pocket housings Q at various spaced locations along the underside of the panel. Since a hook H must engage one of these latching pins L in order to secure the wall and ceiling panels W, P together, this spacing effectively limits positioning of the wall panel W relative to the ceiling panel P to particular spaced locations. As a result, design options are also limited. For example, a wall panel including an access door may only be placed in certain positions. Further, the set spacing of the latching pins L often prevents one from altering an existing wall layout or design in order to meet changing needs. This is because the wall panels W cannot be rearranged and still match the permanent spacing of the latching pins L in the ceiling panel P for proper interconnection.

A need is therefore identified for an improved wall panel construction system providing greater design versatility and flexibility.

SUMMARY OF THE INVENTION

Accordingly, it is a primary object of the present invention to provide a structural wall of modular building panels having a unique design overcoming the limitations and disadvantages of the prior art.

An additional object of the present invention is to provide a structural wall and building structure of unparalleled versatility allowing one to custom design the structure so that access openings/doors may be placed wherever desired.

An additional object of the present invention is to provide a structural wall and building structure formed from cooperating panels wherein the panels may be rearranged and shuffled as desired to change the overall wall design and position of openings to allow one to meet changing needs. Advantageously, this is accomplished utilizing the same building panels and, therefore, one does not need to acquire additional panels to create alternative wall designs and arrangements.

An additional object of the present invention is to provide a structural wall panel and building structure allowing customizing or tailoring to meet an individual user's needs. Advantageously, the invention allows this customization to be accomplished with a minimum number of different panels thereby reducing the inventory burden placed upon the manufacturer/supplier of those panels.

Still another object of the present invention is to provide walk-in coolers and freezers constructed from the structural walls of the present invention.

Yet another object of the present invention is to provide a method of constructing a walk-in cooler/freezer providing all the advantages discussed in this document.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a structural wall is provided including first and second cooperating building panels. The first building panel includes first and second skins forming respective first and second opposed panel faces. A first core is provided between the first and second skins. Preferably, the first core is formed from a foam such as urethane or other appropriate material. The first foam filled core has a first exposed portion forming a groove extending substantially continuously across the first building panel. A slotted rail extends substantially continuously across the first exposed portion or groove.

The second building panel includes third and fourth skins forming third and fourth opposed panel faces. A second core, preferably of foam (e.g. urethane or other appropriate material), is provided between the third and fourth skins. The second foam filled core has a second exposed portion forming a tongue. A latch for selectively engaging the slotted rail at substantially any position along the rail projects from the tongue. When the first and second building panels are properly interconnected, the tongue and groove mate and the latch engages the slotted rail to provide a rigid interconnection. Advantageously, as will be better appreciated from the following description, this structural arrangement also allows substantially infinite adjustability of the position of the second building panel relative to the first building panel.

More specifically describing the invention, the slotted rail preferably includes a latch pin that may be fixed substantially anywhere along the length of the slotted rail. The latch of the second building panel is specifically adapted to engage the latch pin to secure the panels together. Preferably, the slotted portion of the rail is substantially v-shaped and includes a pair of opposed, substantially continuous channels for receiving and securely engaging opposite ends of the latch pin. Preferably, the slotted rail also includes a first mounting flange that projects inwardly into the first foam filled core so as to provide secure, fixed positioning of the rail therein. In addition, the latch preferably includes a pivoting hook and a support housing. That support housing includes a second mounting flange which projects inwardly into the second foam filled core to also provide a stable connection.

In accordance with another aspect of the present invention, a building structure is provided. That building structure includes a top wall panel having first and second skins forming respective first and second opposed faces. A first, foam filled core is provided between the first and second skins and an exposed slotted rail extends substantially, continuously across the top wall panel.

In addition, the building structure includes at least one sidewall panel including third and fourth skins forming third and fourth opposed faces. A second foam filled core is provided between the third and fourth skins. The sidewall panel also includes or carries a latch for selectively engaging the slotted rail. In this way, it is possible to provide substantially infinite adjustability to the position of the sidewall panel relative to the top wall panel. Advantageously, this is accomplished while also providing a secure and reliable connection therebetween.

In accordance with a further aspect of the present invention, a walk-in cooler/freezer structure is provided. The walk-in cooler/freezer structure comprises a top wall panel having four side edges with at least four open slots. One open slot extends substantially continuously across the top wall panel parallel and adjacent to each of the four edges. The walk-in cooler/freezer structure also includes a plurality of sidewall panels. Each of the sidewall panels includes a latch for engaging one of the four open slots in order to secure each of the sidewall panels in a desired position relative to the top wall panel.

In accordance with yet another aspect of the present invention a method of constructing a walk-in cooler/freezer is provided. The method may be defined as including the steps of providing a top wall panel with at least one open slot that extends substantially continuously across the panel from a first side thereof to a second, opposite side thereof. In addition, the method includes the step of providing a sidewall panel including a latch. The method also includes the step of positioning the sidewall panel at a desired location relative to the top wall panel along the open slot. Finally, the method includes the engaging of the latch with the open slot to secure the top wall panel and sidewall panel together.

Described another way, the method of constructing a walk-in cooler/freezer comprises the steps of providing a top wall panel having four edges with at least four open slots, one open slot extending substantially continuously across the top wall panel parallel to and adjacent each of the four edges. In addition, the method includes the step of providing a plurality of sidewall panels each including a latch. Further, there is the step of positioning each of the plurality of sidewall panels at desired locations relative to the top wall panel along the four open slots. This is followed by the engaging of each of the latches with one of the open slots to secure the top wall panel and the plurality of the sidewall panels together.

Advantageously, the present invention allows complete adjustability of the sidewall panels relative to the top wall panel. Specifically, while the latches are provided in a fixed relative position, the slotted rail in the cooperating panel is substantially continuous and the latch may engage the rail at any point there along. This allows infinite relative adjustability between the cooperating panels and, therefore, virtually infinite design freedom. Thus, sidewall panels incorporating an opening may be placed substantially in any position along the top wall panel. Further, the panels may be shuffled and connected in substantially any order and arrangement so that one set of panels may be utilized to construct an almost infinite number of layouts or designs. This allows an individual the freedom to redesign a building structure with existing panels to meet changing needs resulting, for example, from changes in consumer demand and the inventory necessary to meet that demand.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 3 is a longitudinal cross-sectional view of the structure shown in FIG. 2;

FIG. 4 is a bottom plan view of a ceiling or top wall panel including a slotted rail adjacent each of the four edges of the panel.

Reference will now be made in detail to the present preferred embodiment of the invention, an example of which is illustrated in the accompanying drawing.

DETAILED DESCRIPTION OF THE INVENTION

Figure 1B:
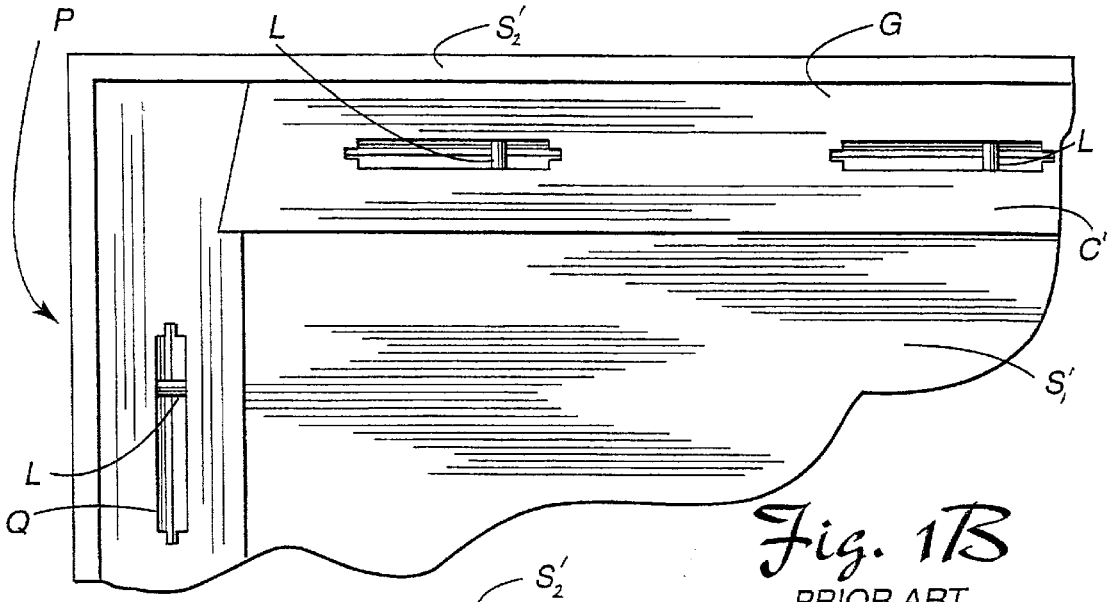
Fig. 1B PRIOR ART
FIG. 1*b* is a fragmentary bottom plan view of a prior art ceiling wall panel showing the latching pins at various spaced locations along the bottom face of the panel.
Figure 1A:
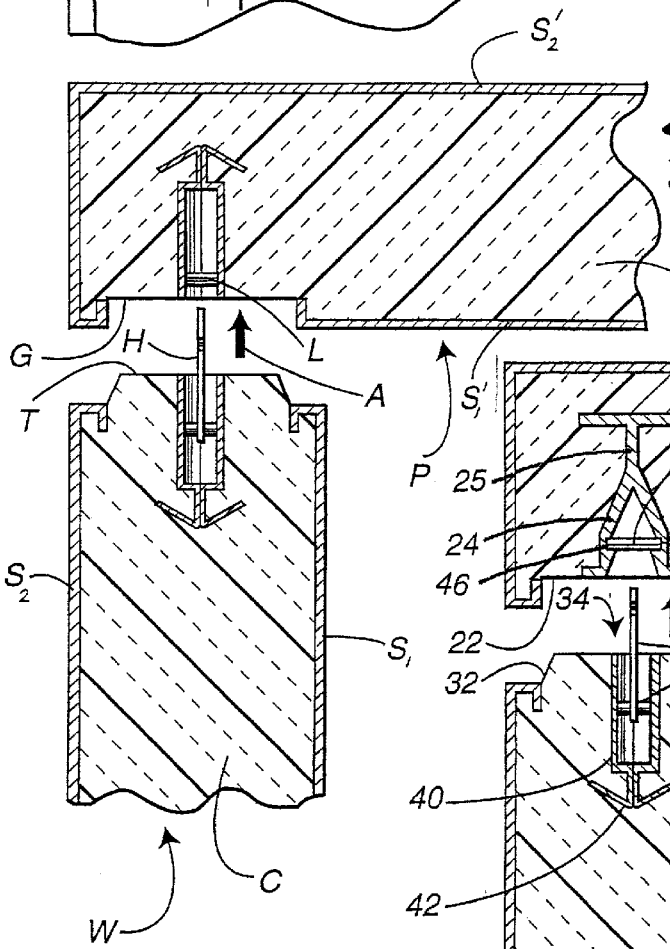
Fig. 1A PRIOR ART
FIG. 1*a* is a cross-sectional view showing a prior art panel arrangement.
Figure 2:
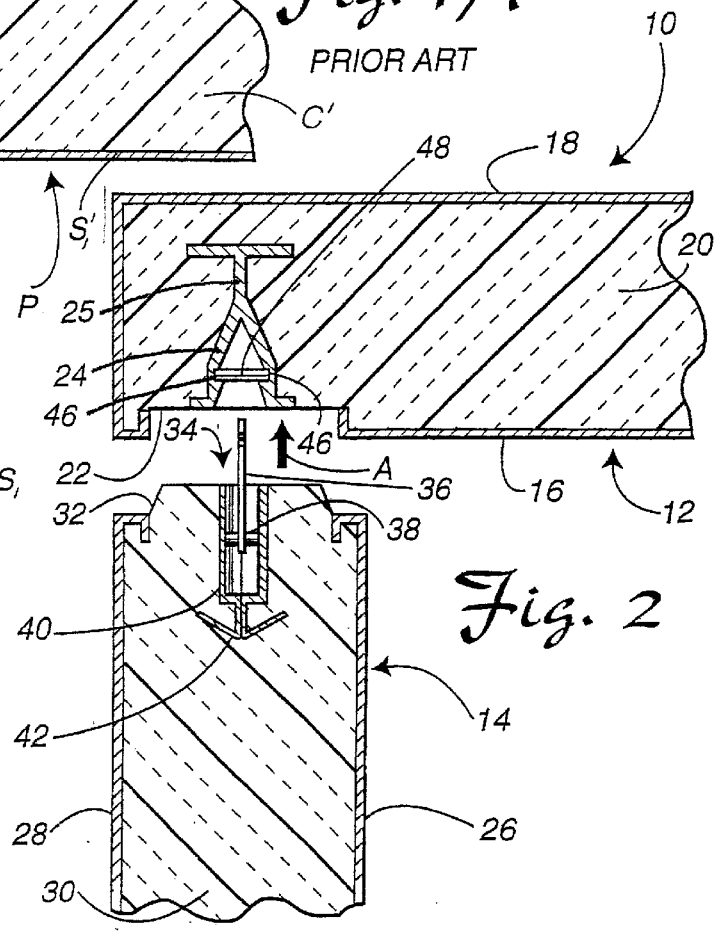
FIG. 2 is a transverse cross-sectional view showing the structural wall/building structure of the present invention.
Figure 5:
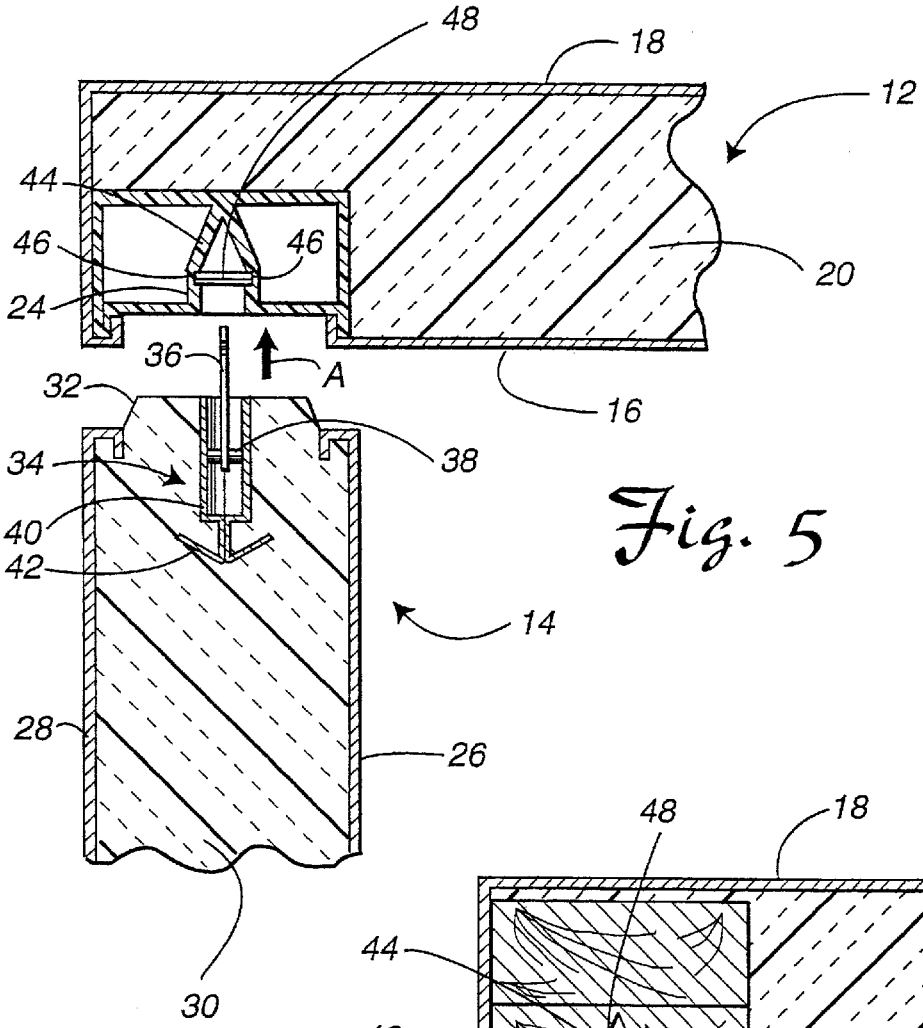
FIGS. 5–9 are various transverse cross-sectional views showing alternative embodiments of the present invention.

Reference is now made to FIGS. 2 and 3 showing the structural wall/building structure 10 of the present invention. That structural wall/building structure 10 is shown and described as a walk-in cooler/freezer. It should be appreciated, however, that this application of the structural wall/building structure 10 of the present invention is intended for purposes of illustration and is not to be considered restrictive. In fact, the structural wall/building structure 10 may be utilized for various other applications including but not limited to testing chambers, lumber drying kilns, clean rooms, drug manufacture and process rooms, forensic and mortuary rooms, refrigerated warehouses, commercial building panels, paint booths, liquid nitrogen and oxygen food freezing tunnels and dry air process enclosures.

As shown in FIGS. 2 and 3, the structural wall/building structure 10 includes a first building panel 12 and a second building panel 14. As shown, the first building panel 12 includes a first skin 16 and a second skin 18 forming respective first and second opposed panel faces. The skins 16, 18 may be formed from substantially any appropriate material known in the art including, but not limited to galvanized steel, galvanized aluminum, stainless steel, plastic or plywood. A first foam filled core 20 is provided between the first and second skins 16, 18. Substantially any appropriate temperature insulating foam known in the art, to be useful for this purpose may be utilized including, for example, expanded polymeric type insulating material such as polystyrene or polyurethane. As further shown in FIGS. 2, 3 and 4, the first foam filled core 20 has at least a first exposed portion which defines a groove 22 that extends substantially continuously across the first building panel 12. An elongated slotted rail 24 extends substantially continuously across the groove 22 and therefore the first building panel 12. The slotted rail 24 is anchored in the core 20 by means of the substantially T-shaped mounting flange 25.

Figure 6:
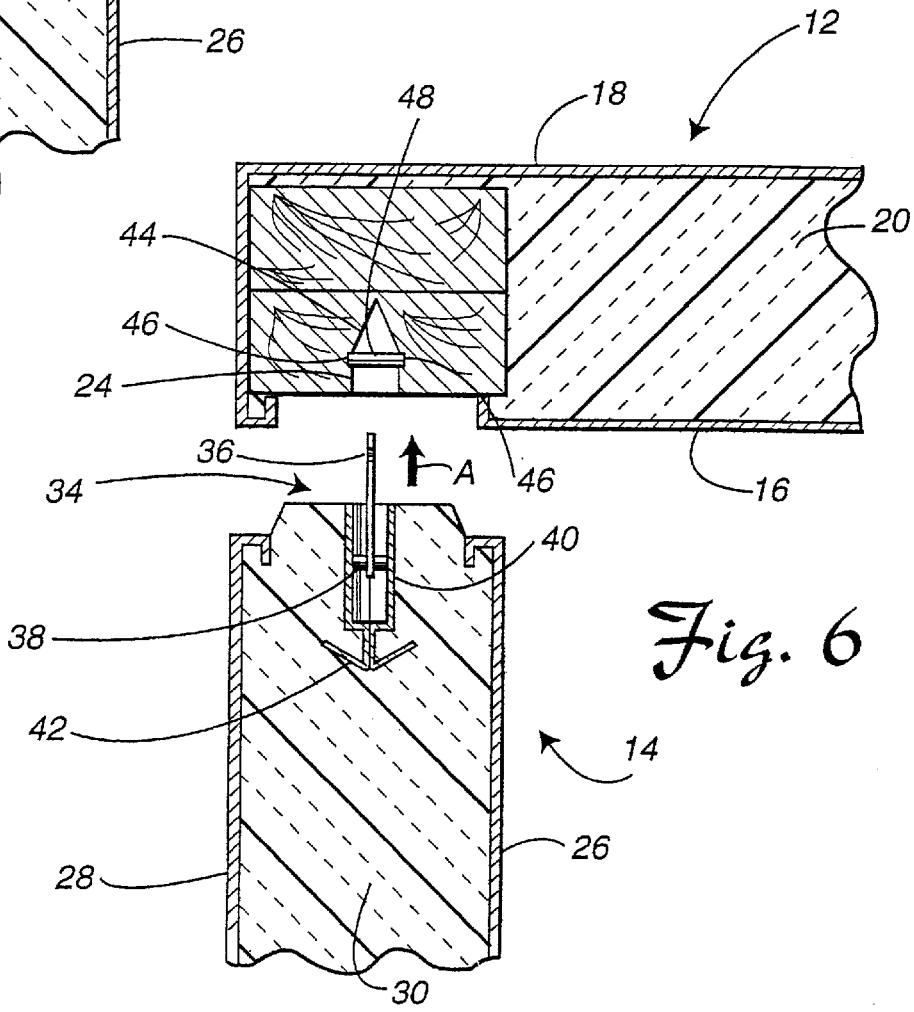
Figure 8:
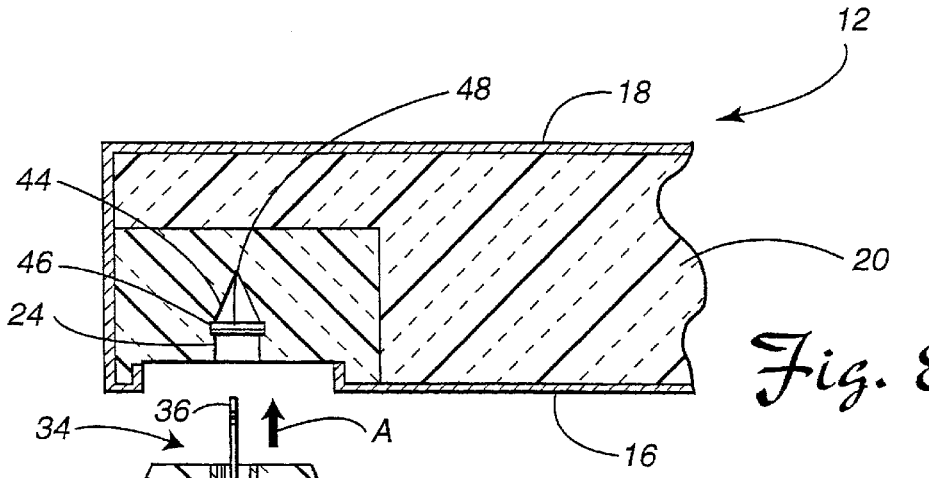
Figure 9:
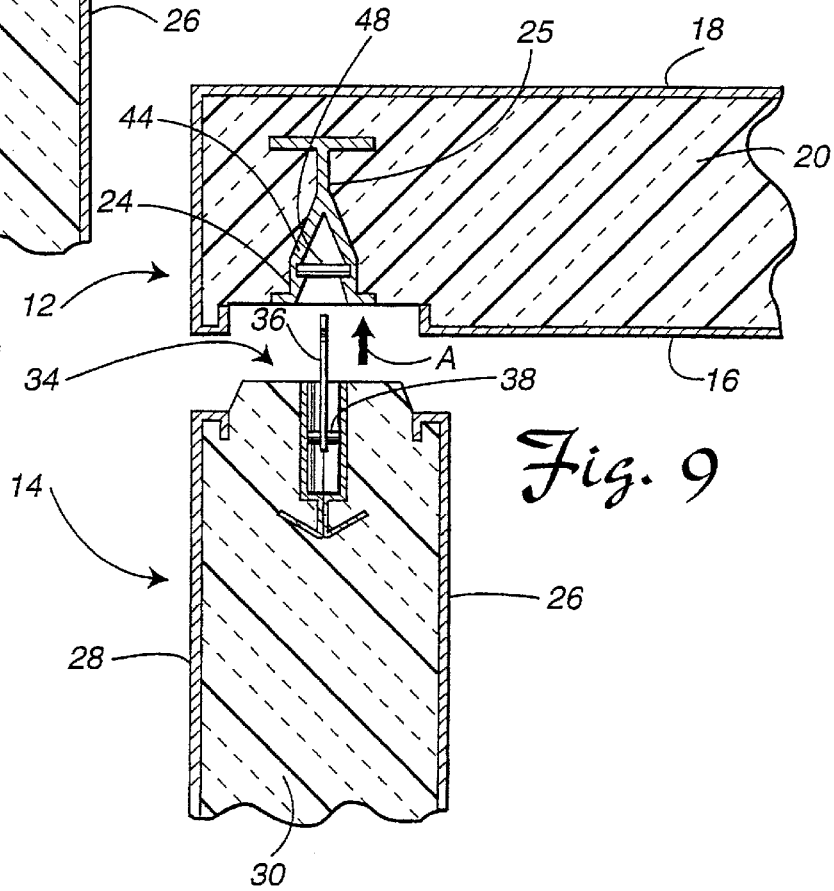

The slotted rail 24 may be constructed from various materials utilizing various processes known in the art. Specifically, the slotted rail 24 may be an aluminum or vinyl extrusion (see FIGS. 2–5). Alternatively, it could be roll formed from heavy gauge aluminum or steel. Still further, the slotted rail 24 could be formed from fiberglass or a fiberglass protrusion (see alternative embodiment shown in FIG. 9). Still further, the slotted rail 24 could be milled from wood or other solid material (see FIG. 6 and the hard urethane rail shown in FIG. 8).

The second building panel 14 is generally similar to the first building panel 12. Specifically, the second building panel 14 includes two skins 26, 28 referenced, respectfully, as the third skin and the fourth skin to distinguish from the first and second skin 16, 18 of the first building panel 12. The third and fourth skins 26, 28 form third and fourth opposed panel faces. A second foam filled core 30 is provided between the third and fourth skin 26, 28. The second core 30 like the first core 20 may be formed from any appropriate material including but not limited to polystyrene or polyurethane.

The second foam filled core 30 includes at least one exposed portion (identified as the second portion to distinguish from the first exposed portion) which defines a tongue 32. When the panels 12, 14 are properly engaged together, the groove 22 defined by the first exposed portion receives the tongue 32 defined by the second exposed portion (note action arrow A in the drawing figures). Additionally, the second building panel 14 carries a latch, generally designated by reference numeral 34 for selectively engaging the slotted rail 24 at substantially any position along the rail. As will be described in greater detail below, this arrangement advantageously allows substantially infinite adjustability of the position of the second building panel 14 relative to the first building panel 12 while also providing a secure and reliable connection therebetween.

The latch 34 may be more specifically described as including a hook 36 that is pivotally connected by means of a hollow shaft 38 to a support housing 40. The lumen of the shaft 38 may define a substantially hexagonal shape in section. Thus, the lumen may be engaged with a hex wrench to pivot the hook 36 from the retracted position where it is received within the support housing 40 to an extended position where it projects from the housing 40 and tongue 32 and engages the slotted rail 24. A mounting flange 42 is secured to the support housing 40. The substantially W-shaped mounting flange 42 is embedded in the second foam core 30 to substantially rigidly anchor the latch 34 in position in the second building panel 14.

Preferably, the slotted rail 24 includes a substantially V-shaped slot 44. Preferably, the substantially V-shaped slot 44 includes a pair of opposed, substantially continuous channels or grooves 46. Additionally, the slotted rail 24 also preferably includes one or more latch pins 48. Each latch pin 48 may be engaged at substantially any position along the longitudinal slot 44 of the slotted rail 24. Specifically, the opposite ends of the latch pin 48 are received and securely engaged in the opposed channels or grooves 46 so that the latch pin extends transversely across the slot 44. A secure frictional binding engagement is provided by inserting the pin longitudinally in the slot 44 and then rotating the pin 90° so that the ends thereof securely and snugly engage in the channels or grooves 46. Thus, in the preferred embodiment, a latch pin 48 is positioned in the slotted rail 24 so that when the second building panel 14 is located in its desired position with respect to the first building panel 12 the latch 34 in the second building panel may be extended to engage and hook around the latch pin 48.

Figure 7:
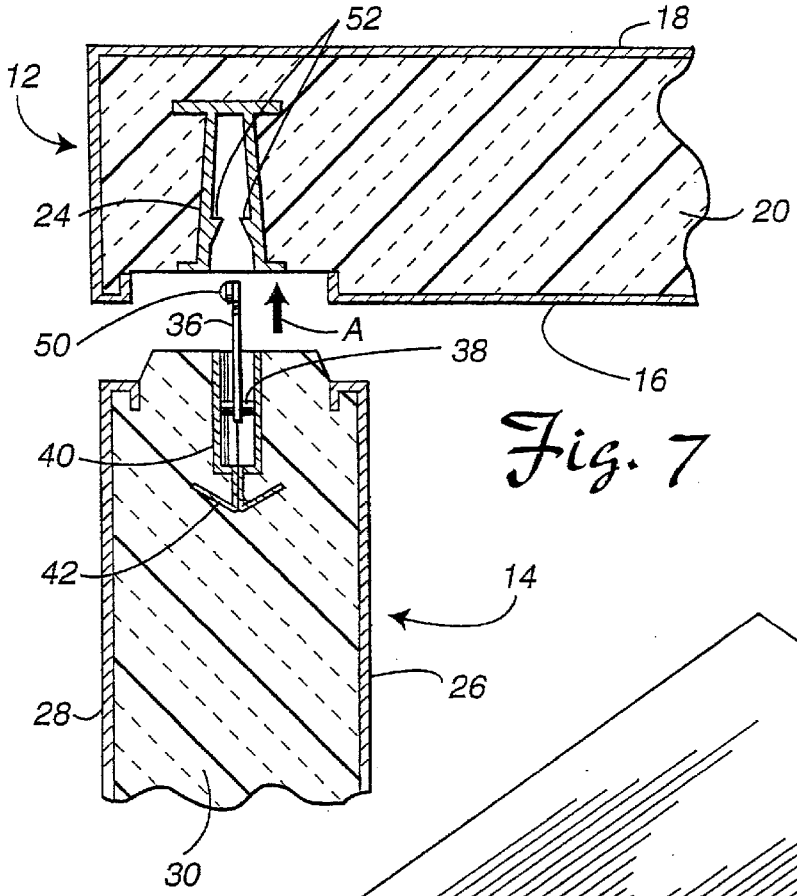

In the alternative embodiment shown in FIG. 7, no latch pin 48 is provided. Instead, the latch 34 includes a nib 50 on at least one side thereof. When the first and second building panels 12, 14 are secured together, the latch 34 extends into the slotted rail 24 and the nib 50 is forced past the constrictions 52 where it is captured and then functions to securely hold the panels together.

The first building panel 12 may be constructed in accordance with procedures well known in the art. Initially, the first skin 16 is placed in a manufacturing fixture. Next, the tongue and groove mold plates are installed around the perimeter of the fixture. This is followed by the installation of the cam lock fasteners on the tongue mold plates. The slotted rail 24 is then installed on the groove mold plates at the desired position. The second skin 18 is then placed in the fixture. The fixture is then closed and locked to hold the required dimension.

Next, urethane foam is injected into the fixture through access holes in the mold plates. The urethane expands and fills the void. The building panel 12 is then left in the fixture for approximately 30 minutes to cure. Upon curing the foam core 20 firmly bonds all the components together. The panel 12 is then removed and cleaned. The latch pins 48 may be installed in the slotted rail 24 at this time or positioned at a later time to meet the specific requirements of the user.

The second building panel 14 is then constructed utilizing the same procedure except the latch 34 is embedded in the second core 30 instead of the slotted rail 34.

The building panels 12 and 14 may be utilized to construct various structures such as, for example, walk-in coolers and freezers. Toward this end, the top wall panel 12 (see FIG. 4 includes first and second skins 16, 18 that form respective first and second opposed faces. A first foam filled core 20 is provided between the skins 16, 18. The top wall panel 12 also includes four side edges 54 and at least four slotted rails 24 defining four substantially V-shaped slots 44 that extends substantially continuously across the top wall panel 12 parallel to and adjacent each of the four edges 54.

Figure 10:
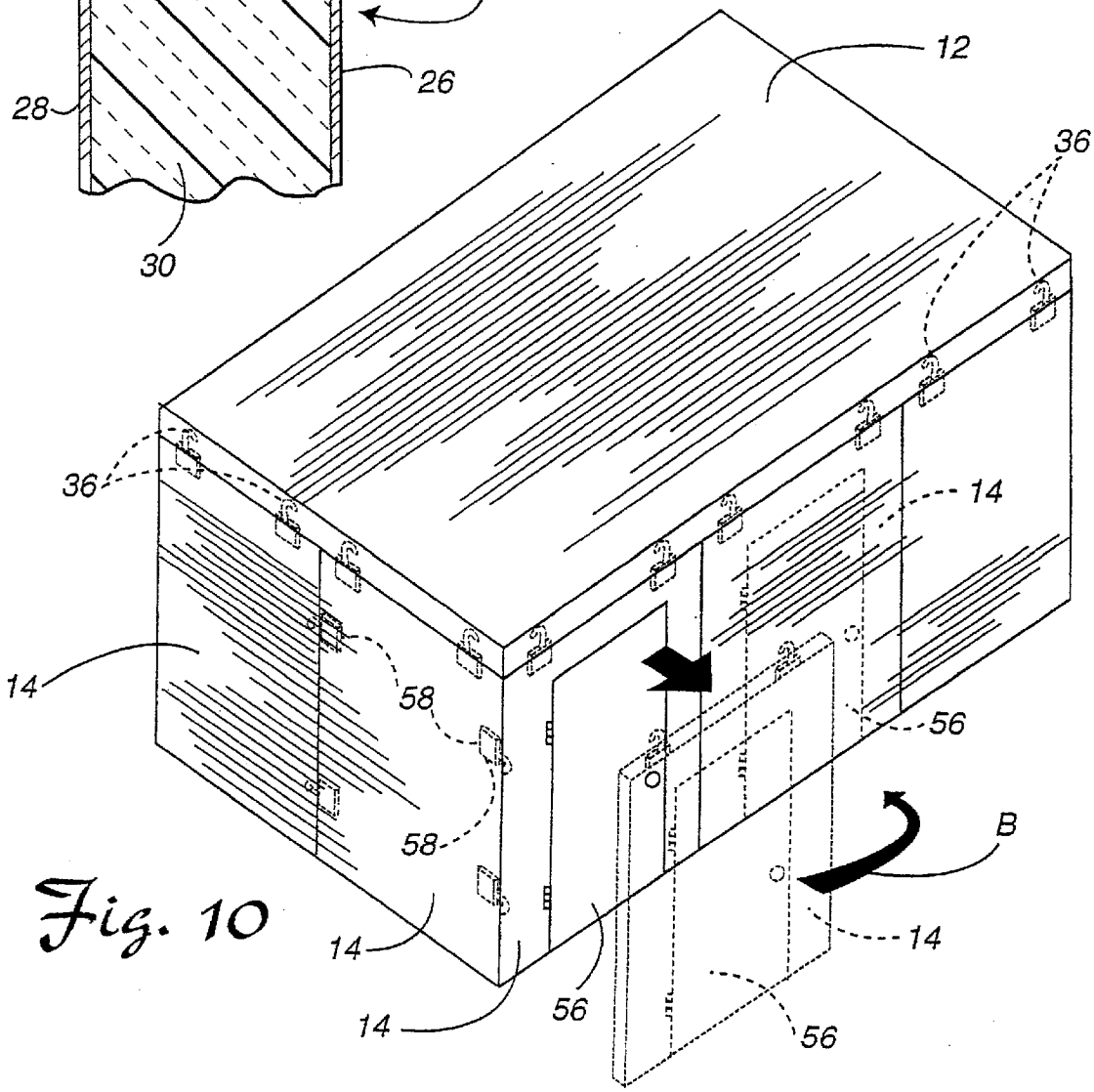
FIG. 10 is a orthogonal view of the cooler/freezer showing the latching pins connected to the their respective wall panels.

A plurality of sidewall panels constructed substantially in accordance with the description of the second building panel 14 are secured to the top wall panel 12 to construct the walk-in cooler/freezer shown in FIG. 10. As shown, one of the sidewall panels 14' includes an access door 56. Depending upon the particular application and the user's needs, this access door 56 may need to be located substantially any where along the top wall panel 12. Since the latch pins 48 may be positioned substantially anywhere along the V-shaped slots 44 to be received and engaged by the hooks 36 of the various sidewall panels 14, 14', an individual has almost infinite flexibility in the placement of the sidewall panel 14, 14' relative to the top wall panel 12. Thus, the sidewall panel 14' with the access door 56 may be placed in substantially any position with the other sidewall panels 14 rearranged accordingly to complete the structure (note, action arrow B and phantom line showing in FIG. 10 illustrating repositioning of access door 56 to the opposite end of cooler sidewall). Of course, added rigidity is provided by the interconnection of cooperating side hooks and latch pins 58 provided in the side edges of the sidewall panels 14, 14'. This is in accordance with known prior art approaches such as described in, for example, U.S. Pat. No. 4,574,537 to Krieger and U.S. Pat. Nos. 3,784,240 and 3,671,006 both to Berkowitz.

In summary, numerous benefits result from employing the concepts of the present invention. As substantially infinite adjustability is provided for the relative positioning of the first and second building panels 12, 14, an individual may customize or tailor the construction of his building structure including the placement of openings in order to meet that individual's particular needs. Further, the selected positioning of openings may be modified to meet changes in those needs by simply rearranging, for example, the sidewall panels 14, 14' relative to the top wall panel 12 so that the sidewall panel 14' with the access door 56 is provided in the newly desired position. Since the latch pins 48 may be moved in position substantially anywhere along the continuous slotted rails 24, a latch pin 48 may always be properly positioned to be engaged by the hook 36 of the latch 34 of any one of the sidewall panels. This provides an individual with design flexibility heretofore unavailable in this type of building structure. Further, it significantly reduces the inventory requirements of the supplier/manufacturer. This is because there is no longer any need to stock left and right handed access door sidewall panels 14' since a single panel may be reversed as necessary to meet user needs and corresponding latch pins 48 may be positioned appropriately to provide secure attachment with the top wall panel 12. Thus, the present invention represents a significant advance in the art.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the top wall panel of a cooler could include a slotted rail intermediate its edges for construction of a bulkhead wall between the end walls. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A structural wall, comprising:

first and second cooperating building panels;

said first building panel including first and second skins forming respective first and second opposed panel faces, a first core between said first and second skins and a slotted rail extending substantially continuously across said first building panel;

said second building panel including third and fourth skins forming third and fourth opposed panel faces, a second core between said third and fourth skins and a latch for selectively engaging said slotted rail at substantially any position along said rail so as to allow substantially infinite adjustability of the position of said second building panel relative to said first building panel while also providing a secure and reliable connection therebetween.

2. The structural wall of claim 1, wherein said slotted rail further includes a latch pin that may be fixed substantially anywhere along a length of said slotted rail, said latch engaging said latch pin.

3. The structural wall of claim 2, wherein said slotted rail includes a pair of opposed, substantially continuous channels for receiving and securely engaging opposite ends of said latch pin.

4. The structural wall of claim 3, wherein said slotted rail includes a substantially V-shaped slot.

5. The structural wall of claim 4, wherein said slotted rail includes a first mounting flange that projects inwardly into said first core.

6. The structural wall of claim 5, wherein said latch includes a pivoting hook and support housing.

7. The structural wall of claim 6, wherein said support housing includes a second mounting flange that projects inwardly into said second core.

8. The structural wall of claim 7, wherein said first core includes a first exposed portion defining a groove and said second core includes a second exposed portion defining a tongue, said tongue mating with said groove when said first and second building panels are connected together.

9. A building structure, comprising:

a top wall panel including first and second skins forming respective first and second opposed faces, a first core between said first and second skins and an exposed slotted rail extending substantially continuously across said top wall panel; and at least one side wall panel including third and fourth skins forming third and fourth opposed faces, a second core between said third and fourth skins and a latch for selectively engaging said slotted rail so as to allow substantially infinite adjustability of the position of said at least one sidewall panel relative to said top wall panel while also providing a secure and reliable connection therebetween.

10. A cooler structure, comprising:

a top wall panel having four side edges with at least four open slots, one open slot extending substantially continuously across said top wall panel parallel to and adjacent each of said four edges; and a plurality of sidewall panels, each of said sidewall panels including a latch for engaging one of said at least four open slots at substantially any position along said at least four open slots so as to allow substantially infinite adjustability of at substantially any position along said at least four open slots at substantially any position along said at least four open slots so as to allow substantially infinite adjustability of each of said sidewall panels to a desired position relative to said top wall panel.

11. A method of constructing a cooler, comprising:

providing a top wall panel with at least one open slot that extends substantially continuously across said panel from a first side thereof to a second, opposite side thereof;

providing a sidewall panel including a latch;

positioning said sidewall panel at a desired location relative to said top wall panel along said at least one open slot; and engaging said latch with said open slot at substantially any position along said open slot so as to allow substantially infinite adjustability of said sidewall panel relative to said top wall panel.

12. A method of constructing a cooler, comprising:

providing a top wall panel having four edges with at least four open slots, one open slot extending substantially continuously across said top wall panel parallel to and adjacent each of said four edges;

providing a plurality of sidewall panels at desired locations relative to said top wall panel along said at least four open slots; and engaging each of said latches with one of said at least four open slots at substantially any position along said at least four open slots so as to allow substantially infinite adjustability of said plurality of saidewall panels relative to said top wall panel.

13. A structural wall, comprising:

first and second cooperating building panels, said first building panel including a slotted rail extending substantially continuously across said first building panel and said second building panel including a latch for selectively engaging said slotted rail at substantially any position along said rail so as to allow substantially infinite adjustability of the position of said second building panel relative to said first building panel while also providing a secure and reliable connection therebetween.

14. The structural wall of claim 13, wherein said slotted rail further includes a latch pin that may be fixed substantially anywhere along said slotted rail, said latch engaging said latch pin.

15. The structural wall of claim 14, wherein said slotted rail includes a pair of opposed, substantially continuous channels for receiving and securely engaging opposite ends of said latch pin.

16. The structural wall of claim 15, wherein said slotted rail includes a substantially V-shaped slot.

17. The structural wall of claim 16, wherein said slotted rail includes a first mounting flange that projects inwardly into said first building panel.

18. The structural wall of claim 17, wherein said latch includes a pivoting hook and support housing.

19. The structural wall of claim 18, wherein said support housing includes a second mounting flange that projects inwardly into said second building panel.

* * * * *

UNITED STATES PATENT AND TRADEMARK OFFICE

CERTIFICATE OF CORRECTION

PATENT NO : 6,119,427

DATED : September 19, 2000

INVENTOR(S) : Larry W. Wyman; James V. Kinser, Jr.

It is certified that error appears in the above-identified patent and that said Letters Patent are hereby corrected as shown below:

In Claim 10 at column 8, lines 51-54, delete "at substantially any position along said at least four open slots so as to allow substantially infinite adjustability of at substantially any position along said at least four open slots".

Signed and Sealed this

First Day of May, 2001

*Attest:*

Nicholas P. Godici

NICHOLAS P. GODICI

*Attesting Officer*

*Acting Director of the United States Patent and Trademark Office*